United States Patent [19]

Kuwamoto et al.

[11] Patent Number: 4,883,606

[45] Date of Patent: Nov. 28, 1989

[54] WATER-SOLUBLE TEMPER ROLLING OIL AND METHOD OF TEMPER ROLLING

[75] Inventors: Hiroshi Kuwamoto, Fukuyama; Shuichi Iwado, Okayama; Yoichi Koga; Tomoya Izushi, both of Fukuyama; Toshimi Muto, Hiratsuka; Nobuomi Kuroi, Yokohama, all of Japan

[73] Assignees: Nippon Kokan Kabushiki Kaisha; Yushiro Chemical Industry Co., Ltd., both of Tokyo, Japan

[21] Appl. No.: 105,982

[22] Filed: Oct. 7, 1987

[30] Foreign Application Priority Data

Oct. 13, 1986 [JP] Japan ..... 61-241526

[51] Int. Cl.[4] ..... C10M 105/58; C10M 105/74

[52] U.S. Cl. ..... 252/32.5; 252/49.3; 252/50

[58] Field of Search ..... 252/32.5, 49, 49.3, 252/50

[56] References Cited

U.S. PATENT DOCUMENTS

| | | | |
|---|---|---|---|
| 3,933,661 | 1/1976 | Abrams | 252/32.5 |
| 4,585,564 | 4/1986 | Tohmata | 252/32.5 |
| 4,637,885 | 1/1987 | Kuwamoto | 252/32.5 |
| 4,650,595 | 3/1987 | Nagamori | 252/32.5 |
| 4,663,061 | 5/1987 | Kuwamoto | 252/32.5 |

FOREIGN PATENT DOCUMENTS

| | | |
|---|---|---|
| 56-1397 | 7/1981 | Japan . |
| 59-1686 | 1/1984 | Japan . |
| 60-255896 | 12/1985 | Japan . |
| 61-7395 | 1/1986 | Japan . |

*Primary Examiner*—William R. Dixon, Jr.
*Assistant Examiner*—James M. Hunter, Jr.
*Attorney, Agent, or Firm*—Lowe, Price, LeBlanc, Becker & Shur

[57] ABSTRACT

The present invention relates to a temper rolling oil which comprises:

(A) a water-soluble cationic compound prepared by neutralizing a condensation product obtained by reacting the following compounds 1 to 3 with each other by heating:

1. an aliphatic dicarboxylic acid,
2. at least one amino compound represented by the following formulae (a) to (c):

(a)

(b)

$H_2N(C_2H_4NH)_nH$, and (c)

3. a particular polyethyleneimine, with an oxoacid of phosphorus, (B) an aqueous rust preventive, and (C) water.

The present invention is also concerned with a method of temper rolling which, comprises of conducting temper rolling at a reduction ranging from 0.5 to 30% using a dilute solution prepared by diluting a temper rolling oil of the kind as described above, so that the concentration of a water-soluble cation compound contained therein is 300 to 5,000 ppm.

4 Claims, 4 Drawing Sheets

WATER-SOLUBLE TEMPER ROLLING OIL AND METHOD OF TEMPER ROLLING

BACKGROUND OF THE INVENTION

1. Field of the Invention:

This invention relates to water-soluble temper rolling oil and a method of temper rolling using the same.

2. Description of the Prior Art:

In general, a cold rolled carbon steel sheet is manufactured by pickling hot rolled steel and then subjecting the pickled hot rolled steel to a series of steps, i.e., cold rolling, annealing and temper rolling. In conducting the temper rolling, a temper rolling oil is used. This temper rolling oil is desired to not only have an appropriate lubricity, detergency sufficient to wash metal wear debris formed, and excellent rust preventive properties, but also to permit uniform application of a final rust preventive oil in a subsequent step that is inexpensive.

Examples of conventional temper rolling oils include an aqueous solution composed mainly of sodium nitrite and alkanolamine having excellent rust preventive properties and an aqueous solution containing at least two alkali metal salts of organic acids such as aliphatic monocarboxylic acid, hydroxycarboxylic acid, aliphatic dibasic acid, benzoic acid, and a nitro group- or amino group-substituted benzoic acid, as disclosed in the laid-open Japanese patent publication Nos. 56-81397, 59-1686, and 60-255896. In recent years, it has been required that, in addition to the above-mentioned properties, the temper rolling oil imparts advanced properties, such as (1) high lubricity, (2) high gloss, (3) apparent dryness of the surface of the sheet, and (4) excellent direct paintability.

Specifically, the temper rolling by making use of bright rolls has been conducted using the conventional temper rolling oil at a reduction ranging from 0.5 to 5%. However, in order to impart special properties to materials, it is often necessary to conduct the temper rolling at a reduction exceeding 5% and up to 30%.

In the conventional temper rolling oils, difficulties were encountered in conducting high reduction temper rolling at a reduction exceeding 10%. Further, even in the case of the temper rolling at a reduction of 5% or less, the conventional temper rolling oil brought about a jumping phenomenon. Therefore, no consistent correlation could be attained between the load and the elongation percentage of the steel sheet, which made it difficult to adjust the elongation percentage through increase or decrease in the load.

Moreover, temper rolling at a high reduction cannot be conducted using the conventional temper rolling oils, which leads to the drawback that conventional temper rolling oils cannot produce a sheet having a high surface gloss.

In temper rolling by making use of either bright rolls or dull rolls, the conventional temper rolling oils provided apparent wetness with respect to the surface of the steel sheet, i.e., and appearance as if an oil adhered thereon, which made it impossible to give apparent dryness. Further, when the conventional temper rolling oils were used, no good adhesive property of a coating could be obtained unless the adherent was removed in a washing step when practicing the coating of the steel sheet.

The present inventors have made extensive and intensive studies with a view to developing a temper rolling oil capable of providing a steel sheet having the abovemetioned additional properties as well. This led to an invention as described in the laid-open Japanese patent publication No. 61-7395 which relates to a temper rolling oil comprising of a water-soluble cationic compound, prepared by neutralizing a condensation product composed of a specific aliphatic dibasic acid and a specific polyamine with an oxoacid of phosphorus, in a concentration of 300 to 5,000 ppm. This invention contributed to the attainment of the above-mentioned purpose of imparting advanced properties such as (1) high lubricity, (2) high gloss, (3) apparent dryness of the surface of the sheet, and (4) excellent direct coating properties.

However, since in the temper rolling oil as described in the laid-open Japanese patent publication No. 61-7395, the number of basic nitrogen atoms contained in the condensation product which forms an essential component, i.e., and aqueous cationic compound, is small, the condensation product becomes water soluble when it is neutralized with an acid of phosphorus. However, the use of the temper rolling oil in combination with the above-mentioned rust preventive component leads to a remarkable decrease in the water solubility. For this reason, in the case of the temper rolling oil as described in the above-mentioned laid-open publication, the allowable maximum amount of addition of a rust preventive component was as small as about 1,000 ppm, and the addition in an amount exceeding this allowable limit brought about precipitation of the lubricating component, i.e., water-soluble cationic compound, which lowered the concentration thereof. This in turn caused not only a decrease in the effect attained therefrom but also to the occurrence of glossy spots called mottling because precipitated water-insoluble matter intruded between the steel sheet and the rolls. When the temper rolling was conducted using this temper rolling oil and bright rolls at a relatively high reduction, water was sufficiently drained off, so that a rolled coil was free from rusting even during its storage. On the other hand, the temper rolling at a low reduction or the temper rolling by making use of dull rolls brought about insufficient draining of water, which in turn led to occurrence of spotted rust during storage of a rolled coil.

SUMMARY OF THE INVENTION (First Invention)

The first invention described in this specification is concerned with a temper rolling oil. The temper rolling oil comprises:

(A) a water-soluble cationic compound prepared by neutralizing a condensation product obtained by reacting the following compounds (1) to (3) with each other by heating:

(1) an aliphatic dicarboxylic acid having 6 to 22 carbon atoms, (2) at least one amino compound represented by the following formulae (a) to (c):

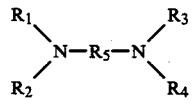

(a)

(wherein $R_1$ to $R_4$ are each a hydrogen atom or an alkyl group having 1 to 3 carbon atoms, provided that at least one of them is a hydrogen atom; and $R_5$ is an alkylene group having 1 to 4 carbon atoms),

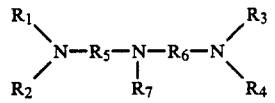

(b)

(where in $R_1$ to $R_4$ and $R_7$ are each a hydrogen atom or an alkyl group having 1 to 3 carbon atoms, provided that at least one of them is a hydrogen atom; and $R_5$ and $R_6$ are each an alkylene group having 1 to 4 carbon atoms), and (c) $H_2N(C_2H_4NH)_nH$ (wherein n is an integer of 3 to 5), and (3) a polyethyleneimine having an average molecular weight of 300 to 2,000, with at least one oxoacid of phosphorus selected from among those belonging to the following groups (d) to (f):

(d) phosphoric acid, phosphorous acid, hypophosphorous acid, and perphosphoric acid;

(e) a condensation product of an oxoacid of phosphorus selected from among pyrophosphoric acid, trimetaphosphoric acid, tetrametaphosphoric acid, pyrophosphorous acid, polymetaphosphorous acid, and diperphosphoric acid; and (f) a compound selected from among those represented by the following formulae (I) to (III):

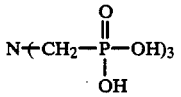

(I)

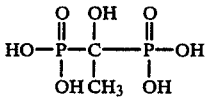

(II)

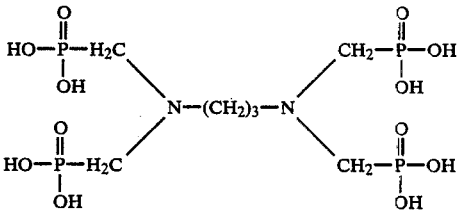

(III)

(B) an aqueous rust preventive, and (C) water.

(Second Invention)

The second invention described in this specification is concerned with a method temper rolling by making use of a temper rolling oil of the kind as mentioned above. Specifically, the method comprises of diluting a temper rolling oil of the kind as mentioned above so as to have a water-soluble cationic compound concentration of 300 to 5,000 ppm and conducting temper rolling using the resulting diluted solution at a reduction ranging from 0.5% to 30%.

DETAILED DESCRIPTION OF THE PREFERRED EMBODIMENTS OF THE INVENTION

Figure 1:
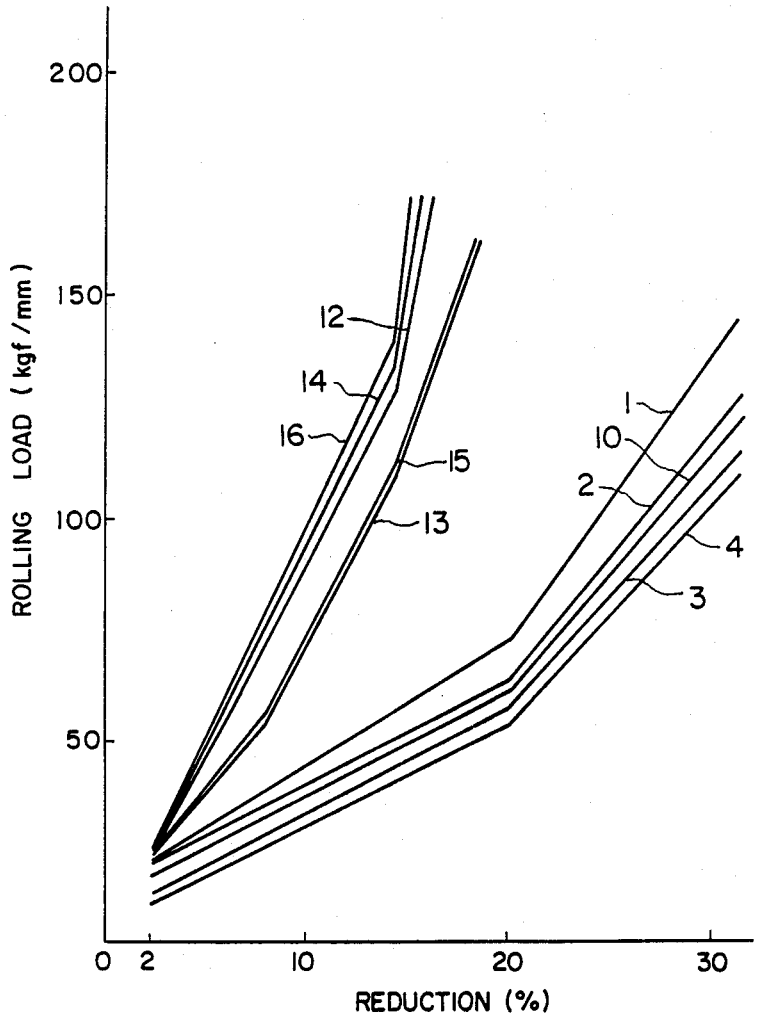
FIG. 1 is a graph showing the relationship between the reduction and the load with respect to an example of the present invention and a conventional temper rolling oil.

The components constituting the temper rolling oil of the first invention and starting materials for use in preparing individual components thereof will now be described in detail.

(Water-Soluble Cationic Compound)

The water-soluble cationic compound which is a component of the composition according to the present invention can be easily obtained by neutralizing a condensation product of an aliphatic dicarboxylic acid, an amine and a polyethyleneimine with an oxoacid of phosphorus.

(Condensation)

The first step of preparing a water-soluble cationic compound comprises condensing an aliphatic dicarboxylic acid with an amine and a polyethyleneimine. In this step, an iron reactor equipped with a thermometer, a nitrogen gas inlet tube, and agitator, and a reflux condenser through a dehydrating tube is charged with predetermined amounts of an aliphatic dicarboxylic acid, an amine, a polyethyleneimine and xylene as a reaction medium, and a dehydration reaction is allowed to proceed in a nitrogen atmosphere at 160° to 170° C. for 4 to 5 hrs' while xylene is refluxed, thereby producing a condensation product. In the condensation reaction of the aliphatic dicarboxylic acid with the amino compound (including the polyethyleneimine), the molar ratio of both starting materials may be 1:2 to 2:1. However, in order to prepare a product exhibiting excellent lubricity, it is preferred that the molar ratio be 1:1 to 1:1.5.

(Neutralization)

The second step of preparing the water-soluble cationic compound is a step of neutralizing the condensation product obtained in the step of condensation. The step of neutralization can be easily conducted as follows. An aqueous solution of a predetermined amount of an oxoacid of phosphorus determined through calculation based on the total amine value of the condensation product in water is provided. The condensation product is added to the aqueous solution, and the resulting mixture is agitated with heating, if necessary, to allow the condensation product to dissovle in the aqueous solution, thereby conducting the neutralization.

In order for the water-soluble temper rolling oil having a water-soluble cationic compound concentration of 300 to 5,000 ppm and a water-soluble rust preventive concentration of 0.5 to 10% (i.e., a preferred embodiment of the temper rolling oil of the present invention) to be employed in temper rolling in a stable state, it is preferred that the ratio of the total number of carbon atoms of the aliphatic dicarboxylic acid contained in the water-soluble cationic compound to the total number of basic nitrogen atoms derived from the amino compound (including the polyethyleneimine), i.e., $$\frac{\text{total number of basic nitrogen atoms}}{\text{total number of carbon atoms}}$$

be at least 0.35.

(Aliphatic Dicarboxylic Acid)

The aliphatic dicarboxylic acid to be used in preparing the water-soluble cationic compound may be a straight-chain or branched dicarboxylic acid. These dicarboxylic acids may be saturated or unsaturated. It is preferred that the dicarboxylic acid has 6 to 22 carbon atoms. When the number of carbon atoms is less than 6, no sufficient lubricity can be imparted. On the other hand, when the number of carbon atoms exceed 22, no sufficient water solubility can be imparted.

Examples of the aliphatic dicarboxylic acid to be used in the invention described in the specification include adipic acid, pimelic acid, suberic acid, azelaic acid, sebacic acid, and 1,10-dicarboxydecane.

(Amino Compound)

The amino compound to be used in preparing the water-soluble cationic compound may be one containing two or more basic nitrogen atoms and capable of condensing with the aliphatic dicarboxylic acid. However, in order to obtain a water-soluble compound, it is preferred that the number of carbon atoms of an alkyl group be 3 or less when the amino compound has an alkyl group and that the number of carbon atoms of an alkylene group be 4 or less when the amino compound has an alkylene group.

The molecular weight of the polyethyleneimine is 300 or more, preferably 2,000 or less. A polyethyleneimine having a molecular weight of less than 300 is commercially available but with difficulty. On the other hand, a polyethyleneimine having a molecular weight exceeding 2,000 has a high viscosity and, therefore, brings about difficulties in the operation of the reaction.

(Neutralizing Agent)

Examples of the neutralizing agent for neutralizing the above-mentioned condensation product to obtain the water-soluble cationic compound include organic acids such as acetic acid, oxalic acid and citric acid, and inorganic acids such as hydrochloric acid, nitric acid, sulfuric acid, oxoacids of phosphorus and boric acid. In order to impart useful lubricity and rust preventive properties, it is preferred that the neutralizing agent be oxoacid ions of phosphorus. Other neutralizing agents are unsuitable because they have problems with respect to either lubricity or rust preventive properties or both of them.

The amount of the oxoacid of phosphorus is 50 to 120%, preferably 75 to 100%, based on the amount of the oxoacid of phosphorus required for neutralizing the total amine value.

(Water-Soluble Rust Preventive)

In the invention described in the specification, known water-soluble rust preventives may be used. It is preferred that, when the temper rolling oil of the invention described in this specification is used, it has a water-soluble rust preventive concentration of 0.5 to 10% by weight in terms of the concentration of the active component. When the concentration of the active component is less than 0.5% by weight, the rust preventive properties are poor. A concentration exceeding 10% by weight is also unfavorable because it does not contribute to a further improvement in the rust preventive effect and, at the same time, tends to cause the formation of deposits on the rolls in steps subsequent to temper rolling.

(Composition of Temper Rolling Oil)

The temper rolling oil of the present invention is composed of an aqueous solution containing the above-mentioned essential components and optional components.

When the temper rolling oil of the present invention is used in temper rolling, the concentration of the water-soluble cationic compound contained therein is preferably 300 to 5,000 ppm. When the concentration is less than 300 ppm, temper rolling at a reduction exceeding 20% cannot be smoothly conducted. On the other hand, a concentration exceeding 5,000 ppm is uneconomical because the effects with respect to lubricity, washing capability, etc. cannot be further enhanced.

When water can be sufficiently drained off as in the case of temper rolling at a high reduction using bright rolls, the concentration of the water-soluble rust preventive may be low because a strong rust preventive power is not demanded. On the other hand, when the temper rolling is conducted using bright rolls at a low reduction or using dull rolls, the water-soluble rust preventive is used in a high concentration because water is liable to be drained off rather insufficiently.

EXAMPLES

For easy understanding of the present invention, the invention will now be described with reference to the following examples which should not be construed as limiting the scope of the present invention.

(Examples of Water-soluble Cationic Compound)

Water-soluble cationic compound A-1

The above-mentioned reactor was charged with 2.0 mol of 1,10-dicarboxydecane, 1.0 mol of triethylenetetramine, 1.0 mol of polyethyleneimine having an average molecular weight of 300, and 1.0 mol of methyliminobispropylamine. The resulting mixture was kept in a nitrogen atmosphere at 140° to 180° C. for 5 hrs' to allow a dehydration reaction to proceed, thereby obtaining a condensed product. To the condensed product was added phosphoric acid in an amount of 90% of the amount required for neutralizing the total amine value of the condensed product, thereby obtaining a water-soluble cationic compound.

Water-soluble cationic compound A-2

2.0 mol of 1,10-dicarboxydecane, 1.0 mol of polyethyleneimine having an average molecular weight of 300, 1.0 mol of polyethyleneimine having an average molecular weight of 600, and 1.0 mol of methyliminobispropylamine were reacted with each other under the same conditions as those mentioned above, thereby obtaining a condensed product. To the condensed product was added phosphoric acid in an amount of 80% of the amount required for neutralizing the total amine value of the condensed product, thereby obtaining a water-soluble cationic compound.

Water-soluble cationic compound A-3

1 mol of adipic acid, 1 mol of 1,10-dicarboxydecane, 1 mol of methyliminobispropylamine, 1 mol of diethylenetriamine, and 1 mol of polyethyleneimine having an average molecular weight off 600 were reacted with each other under the same conditions as those mentioned above, thereby obtaining a condensed product. To the condensed product was added phosphoric acid in an amount required for neutralizing the total amine value of the condensed product, thereby obtaining a water-soluble cationic compound.

Water-soluble cationic compound A-4

2.0 mol of 1,10-dicarboxydecane, 1.0 mol of methyliminobispropylamine, and 2 mol of polyethyleneimine having an average molecular weight of 600 were reacted with each other under the same conditions as those mentioned above, thereby obtaining a condensed product. To the condensed product was added phosphoric acid in an amount of 85% of the amount required for neutralizing the total amine value of the condensed product, thereby obtaining a water-soluble cationic compound.

(Examples of Water-Soluble Rust Preventive)

Water-soluble rust preventive B-1

(A rust preventive as disclosed in the laid-open Japanese patent publication No. 56-81397)

| | |
|---|---|
| succinic acid | 15% by weight |
| caprylic acid | 1% by weight |
| potassium hydroxide | 0.5% by weight |
| monoethanolamine | 30% by weight |
| sodium gluconate | 3% by weight |
| water | 50.5% by weight |

Water-soluble rust preventive B-2

(A rust preventive as disclosed in the laid-open Japanese patent publication No. 59-1686)

| | |
|---|---|
| P—nitrobenzoic acid | 20% by weight |
| ethylamine | 30% by weight |
| acrylic acid | 8% by weight |
| nonionic surfactant | 1% by weight |
| water | 41% by weight |

Water-soluble rust preventive B-3

(A rust preventive as disclosed in the laid-open Japanese patent publication No. 60-255896)

| | |
|---|---|
| p-nitrobenzoic acid | 10% by weight |
| adipic acid | 5% by weight |
| monoethanolamine | 10% by weight |
| diisopropanolamine | 10% by weight |
| sodium citrate | 3% by weight |
| nonionic surfactant | 1% by weight |
| water | 61% by weight |

Water-soluble rust preventive B-4

| | |
|---|---|
| molybdic acid | 10% by weight |
| 2,4,6-tris(5-pentylcarboxylamino)-1,3,5-triazine | 5% by weight |
| diethanolamine | 10% by weight |
| triethanolamine | 10% by weight |
| water | 65% by weight |

Water-soluble rust preventive B-5

| | |
|---|---|
| p-nitrobenzoic acid | 10% by weight |
| sebacic acid | 1% by weight |
| aminoethylethanolamine | 19% by weight |
| water | 70% by weight |

(Temper Rolling Oil)

The temper rolling oils as listed in Table 1 were prepared. They were used for temper rolling and also applied to various tests.

TABLE 1

| | water-soluble ionic compound | | | | rust preventive | | | | | |
|---|---|---|---|---|---|---|---|---|---|---|
| | A - 1 | A - 2 | A - 3 | A - 4 | B - 1 | B - 2 | B - 3 | B - 4 | B - 5 | water |
| Ex. | | | | | | | | | | |
| 1 | 0.03 | | | | | | | 1.0 | | 98.97 |
| 2 | 0.15 | | | | | | | 1.0 | | 98.85 |
| 3 | 0.30 | | | | | | | 1.0 | | 98.70 |
| 4 | 0.50 | | | | | | | 1.0 | | 98.50 |
| 5 | | 0.20 | | | | | | | 0.5 | 99.30 |
| 6 | | 0.20 | | | | | | | 2.0 | 97.80 |
| 7 | | 0.20 | | | | | | | 10.0 | 89.80 |
| 8 | | | 0.20 | | 2.0 | | | | | 97.80 |
| 9 | | | | 0.2 | | 2.0 | | | | 97.80 |
| 10 | | | | 0.2 | | | 2.0 | | | 97.80 |
| 11 | | | | 0.2 | | | | 2.0 | | 97.80 |
| Comp. Ex. | | | | | | | | | | |
| 12 | | | | | | | | | 2.0 | 98.00 |
| 13 | | | | | 2.0 | | | | | 98.00 |
| 14 | | | | | | 2.0 | | | | 98.00 |
| 15 | | | | | | | 2.0 | | | 98.00 |
| 16 | | | | | | | | 2.0 | | 98.00 |

1. Examples of temper rolling with a laboratory test mill:

Temper rolling was conducted with the testing oils as listed in Table 1 under the following condition:

| | |
|---|---|
| Work rolls (bright rolls) | 60 mmϕ in diameter |
| back tension | 3.0 Kg/mm$^2$ |
| front tension | 3.0 Kg/mm$^2$ |
| rolling speed | 30 m/min |
| feed rate of temper rolling oil | 0.2 l/min |
| material (SPCC) | 80 × 0.8 mm |

In temper rolling, the following items were tested:

(1) rolling lubricity (2) rust preventive properties
(3) wettability with a final rust preventive
The results will now be described.

(1) Rolling lubricity:

The relationship between the load and the reduction was determined. The results are shown in Table 1. In table 1, the figures attached to individual curves indicate the numbers of the examples or comparative examples. As can be seen from FIG. 1, the rolling loads with respect to both water-soluble cationic compound concentrations of 300 ppm and 5,000 ppm in the examples were lower than those with respect to a water-soluble temper rolling agent concentration of 20,000 ppm in the comparative examples. Further, in the examples, the temper rolling at a reduction ranging from 2% to 30% could be smoothly conducted. On the other hand, in the comparative examples, the temper rolling at a reduction exceeding 15% could not be conducted.

(2) Rust preventive properties:

An SPC coil 0.8 t×80 b (unit: mm) was temper rolled at a length of 10 m at a reduction of 2% with dull rolls having a surface roughness (RZ) of 8 μm, wound in a coil form and allowed to stand in a thermohygrostat kept at a temperature of 35° C. and a relatiave humidity of 80% for 72 hrs, followed by determination of a rusting area. The results are shown in Table 2.

The temper rolling oils of the examples exhibited rust preventive properties remarkably superior to those of the temper rolling oil of Comparative Example 17 (the same oil as that disclosed in the Japanese patent publication No. 61-7395). Further, the temper rolling oils of the examples were found to have improved rust preventive properties over rust preventives per se of Comparative Examples 12 to 16.

(3) Wettability with a final rust preventive oil:

Ten specimens each 80 mm×80 mm were cut out from a steel sheet which had been temper rolled at a reduction of 5 %, put on top of another and allowed to stand for 48 hrs. A commercially available final rust preventive oil was applied to each specimen to observe the wettability. The results are shown in Table 2. The wettability of the examples was superior to that of the comparative examples and was free from occurrence of cissing of the rust preventive oil.

(4) Washing properties test:

The work rolls of the laboratory test mill as used in the above tests were replaced with dull rolls (a diameter of 60 mm; a surface roughness (RZ) of 8 μm), followed by five-pass temper rolling at a reduction of 15% in each pass. With respect to each temper rolling oil sample, four sample sheets each 80×150 mm were cut out from the temper rolled steel sheet. The wear debris deposited on both sides of each sample sheet were carefully wiped off with gauze wetted with water, followed by determination of the deposited wear debris. The amount of wear debris thus determined was converted into the amount of the deposited wear debris per $m^2$. The results are shown in Table 2.

The temper rolling oils of the examples gave deposited wear debris of an amount smaller than that of the deposited wear debris formed by the temper rolling oils of the comparative examples, i.e., exhibited excellent wear debris washing properties.

TABLE 2

| | gloss | presence of surface defects | rust preventive properties (rusting area: %) | wettability with a final rust preventive oil | washing properties (wear debris:mg/$m^2$) |
|---|---|---|---|---|---|
| Ex. | | | | | |
| 1 | O | O | 0.7 | O | 52 |
| 2 | O | O | 0.5 | O | 30 |
| 3 | O | O | 0.5 | O | 28 |
| 4 | O | O | 0.7 | O | 26 |
| 6 | O | O | 0.2 | O | 47 |
| 8 | O | O | 0.7 | O | 32 |
| 9 | O | O | 0.4 | O | 50 |
| 10 | O | O | 0.3 | O | 21 |
| 11 | O | O | 0.9 | O | 25 |
| Comp. Ex. | | | | | |
| 12 | Δ | Δ | 1.8 | Δ | 100 |
| 13 | Δ | Δ | 4.8 | Δ | 125 |
| 14 | Δ | Δ | 1.5 | Δ | 90 |
| 15 | Δ | Δ | 1.8 | Δ | 100 |
| 16 | Δ | Δ | 5.2 | Δ | 110 |
| 17* | O | O | 23 | O | 31 |

(Note)
gloss: O indicates that the surface of the specimen has a specular gloss and clear visibility. Δ indicates that the surface of the specimen has a slightly blurred gloss and unclear visibility.
presence of surface defects: O indicates that the surface of the sheet is free from surface defects called friction pick-up. Δ indicates that baking defects are observed in several places per coil.
wettability with a final rust preventative: O indicates that no cissing of final rust preventative occurs. Δ indicates that the cissing of the final rust preventative is partly observed.
*Comparative Example 17 (corresponding to an example of the laid-open Japanese patent publication No. 61-7395)

| | |
|---|---|
| a water soluble cationic compound which will be indicated later the mark * | 0.5% by weight |
| sodium p-tert-butylbenzoate | 0.05% by weight |
| polyoxyethylene nonylphenyl ether (addition of ethylene oxide: 14 mol) | 0.013% by weight |
| water | balance |

*Water-soluble cationic compound:
1 mol of sebacic acid, 1 mol of 1,18-octadecanedicarboxylic acid, 1 mol of diethylenetriamine, 1 mol of triethylenetetramine, and 1 mol of methyiminobispropylamine were kept at 140 to 180° C. for 5 hrs to allow them to react with other, thereby obtaining a condensation product. To the resulting condensation product was added phosphoric acid in an amount of 80% of the amount required for neutralizing the total amine value of the condensation product, thereby obtaining a water-solubl e cationic compound.

2. Example of temper rolling with a production mill:

(1) Rolling lubricity:

Temper rolling was conducted according to the following specifications. The results are shown in FIGS. 2 and 3.

| | |
|---|---|
| rolling mill: | single-stand four-high mill |
| work rolls: | |
| diameter: | upper roll 535 mm<br>lower roll 534 mm |
| surface roughness: | upper roll (Ra) 0.10 μm<br>bright roll<br>lower roll (Ra) 0.10 μm<br>bright roll |
| material to be rolled: | an annealed material 0.28 mm in thickness × 610 mm in width corresponding to SPCC |
| back tension: | 4.5 $Kg/mm^2$ |
| rolling speed: | 500 m/min |
| feed rate of temper rolling oil: | 12 l/min |
| temper rolling oil: | example . . . composition of Example 6 as shown in Table 1<br>comparative example . . . composition of Comparative Example 15 as shown in Table 1 |

Figure 2:
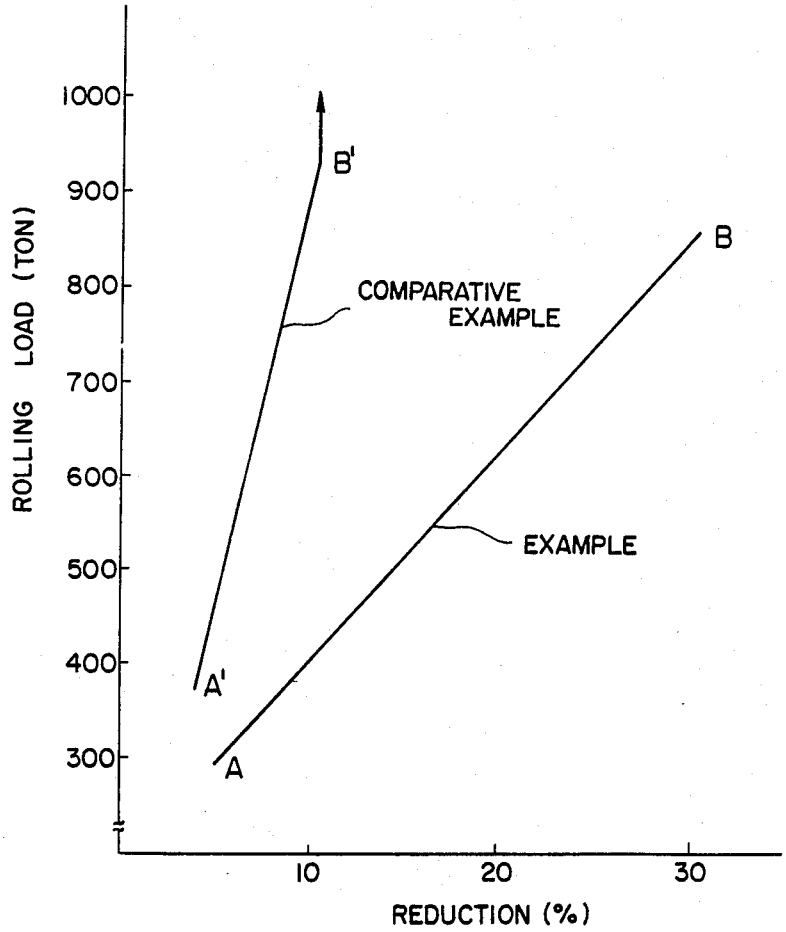
FIG. 2 is a graph showing the relationship between the rolling load and the reduction with respect to an example of the present invention and a conventional temper rolling oil.
Figure 3:
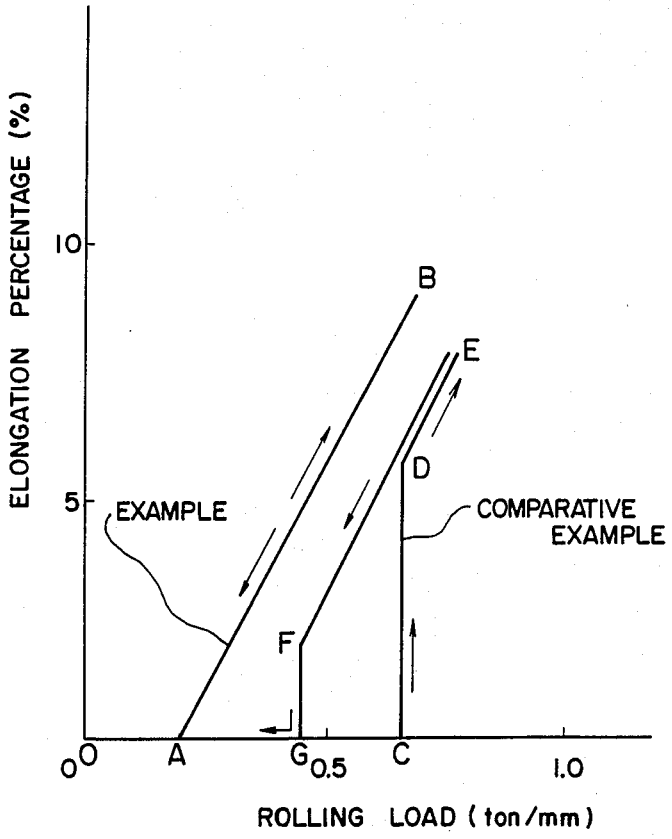
FIG. 3 is a graph showing the relationship between the rolling load and the elongation percentage with respect to an example of the present invention and a conventional temper rolling oil.

FIG. 2 is a graph showing the relationship between the reduction in temper rolling and the rolling load.

As can be seen from FIG. 2, when a temper rolling oil of the example is used, the reduction is increased between the symbol A and the symbol B as the rolling load is increased, and temper rolling at a reduction of 30% is possible when a load of 850 tons is applied. On the other hand, when the temper rolling oil of the comparative example is used, the reduction is increased between the symbol A' and the symbol B' as the rolling load is increased, and temper rolling at a reduction of 10% is possible when a load of 920 tons in applied. However, in this case, even when the rolling load is increased over 920 tons, the reduction cannot be increased over 10%.

That is, the use of the temper rolling oil of the example makes it possible to conduct temper rolling at a reduction of up to 30%, while temper rolling at a reduction exceeding 10% cannot be conducted when the temper rolling oil of the comparative example is used.

FIG. 3 shows the relationship between the rolling load and the elongation percentage in the case where temper rolling is conducted while the rolling load is continuously increased or decreased. The arrows in FIG. 3 indicate the direction of the change in rolling load, i.e., temper rolling while increasing the rolling pressure or temper rolling while decreasing the rolling pressure.

As can be seen from FIG. 3, when the temper rolling oil of the example is used, the relationship between the rolling load and the elongation percentage attained in the case where the rolling load is increased during temper rolling, is the same as that attained in the case where the rolling load is decreased during temper rolling (O→A→B and B→A→O). Therefore, the elongation percentage can be adjusted by increasing and decreasing the rolling load. In FIG. 3, O→A and A→O each represent an elastic deformation region. On the other hand, the use of the temper rolling oil of the comparative example leads to different results. Specifically, when temper rolling is conducted while the rolling load is gradually increased, the relationship between the rolling load and the elongation percentage follows a route of O→C→D→E, while when temper rolling is conducted while the rolling load is gradually decreased, the relationship between the rolling load and the elongation percentage follows a route of E→F→G→O. Thus, the elongation percentage is not continuously changed according to the change in the rolling load. Further, when temper rolling is conducted while the temper rolling oil is gradually increased, the elongation percentage is changed according to an increase in the rolling load in a manner different from that in the case where temper rolling is conducted while the temper rolling oil is gradually decreased. Therefore, it is impossible to adjust the elongation percentage by increasing and decreasing the rolling load.

(2) Rust preventive properties:

Temper rolling was conducted according to the following specifications:

| | |
|---|---|
| rolling mill: | single-stand four-high mill |
| work rolls: | |
| diameter: | upper roll 535 mm<br>lower roll 535 mm |
| roughness of roll surface: | upper roll (Ra) 3.2 μm<br>dull roll<br>lower roll (Ra) 3.2 μm<br>dull roll |
| material to be rolled: | |
| dimension: | thickness 0.8 mm<br>width 1,200 mm |
| an annealed material corresponding to SPCC reduction | 1.0% |
| feed rate of temper rolling oil: | 12 l/min |
| temper rolling oil: | example . . . composition of Example 10 as shown in Table 1<br>comparative example . . . composition of Comparative Example 14 as shown in Table 1; and composition of Comparative Example 17 as shown in Table 2 |

The temper rolled coil was allowed to stand within the building of a factory and unwound after 1 day, 1 month, 2 months and 3 months, followed by examination with respect to the occurrence of rust on the surface of the coil. The results are shown in Table 3.

TABLE 3

| temper rolling oil | period of time for allowing the coil to stand | | | |
|---|---|---|---|---|
| | 1 day | 1 month | 2 months | 3 months |
| Ex. 10 | free from rust | free from rust | free from rust | free from rust |
| Comp. Ex. 14 | free from rust | free from rust | free from rust | free from rust |
| Comp. Ex. 17 | occurrence of rust | presence of rust | presence of rust | presence of rust |

Comparative Example 17 with respect to the water-soluble cationic compound as described in the laid-open Japanese patent publication No. 61-7395 exhibited occurrence of rust after 1 day. On the other hand, Example 10 of the present invention and Comparative Example 14 with respect to a practical temper rolling oil did not exhibit occurrence of rust even after 3 months.

Figure 4:
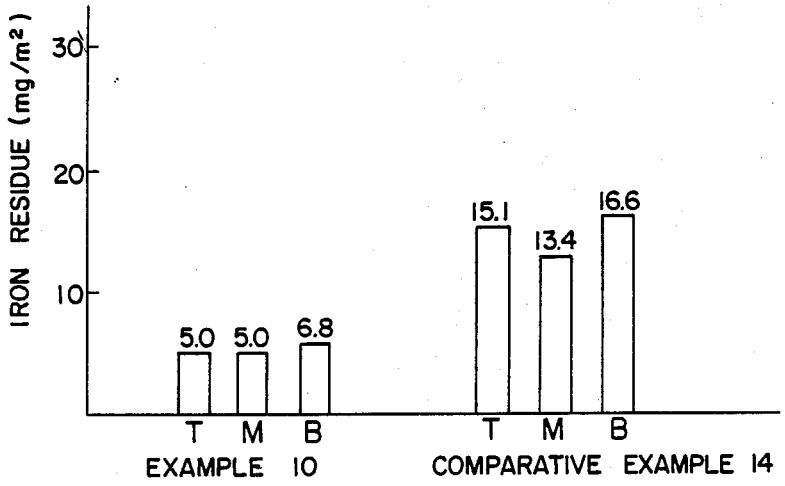
FIG. 4 is a graph showing the amount of iron remaining in a steel after sheet rolling with respect to an example of the present invention and a conventional temper rolling oil.

(3) Iron remaining on steel sheet:

The coil which had been temper rolled by the method as described in the above item 2 was cut 1 day after the occurrence of rust was examined, thereby obtaining a sample. The sample was applied to the test of determination of iron remaining in the steel sheet. The determination was conducted in the same manner as that described with respect to the tests on cleaning properties by making use of a test rolling mill. The results are shown in FIG. 4. In FIG. 4, the symbols T, M, and B respectively indicate a top side (T), a middle side (M), and a bottom side (B) in the longitudinal direction of rolling within the coil.

As can be seen from FIG. 4, the amount of iron remaining on the steel sheet with respect to the example is extremely smaller than that with respect to the comparative example. This shows that the temper rolling oil of the example has an excellent iron debris washing effect.

Figure 5:
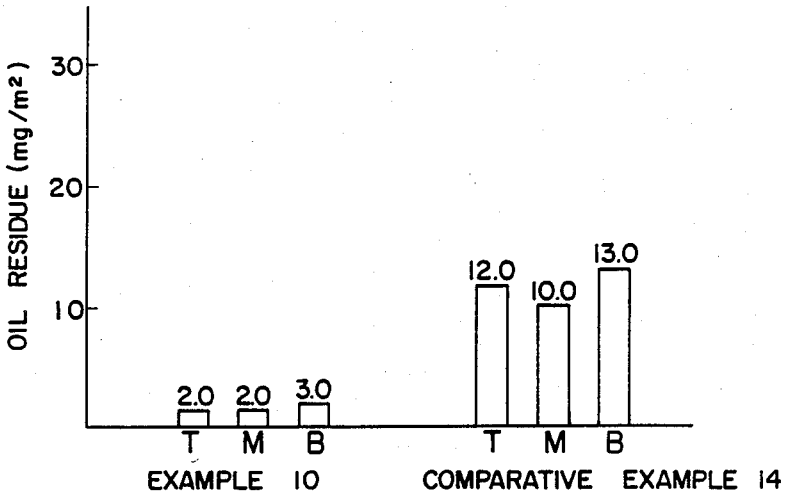
FIG. 5 is a graph showing the amount of oil remaining in a steel sheet after rolling in respect to an example of the present invention and a conventional temper rolling oil.

(4) Oil remaining on steel sheet:

A cut sheet sample obtained by the same method as that mentioned in the above item (3) was washed with water while rubbing and then washed with an alcohol while rubbing, followed by determination of deposited matter thus obtained. The value obtained by subtracting the amount of iron (determined by colorimetry after dissolution in an acid) from the data on the deposited matter was regarded as the residual oil. The results are shown in FIG. 5. In FIG. 5, the symbols T, M, and B respectively have the same meanings as those of FIG. 4. The residual oil of the steel sheet of the example was extremely smaller than that of the comparative example and, therefore, exhibited a dry surface.

(5) Direct paintability:

A cut sheet obtained by the same method as that mentioned in the above item (3) was coated with a bar coater so as to have a coating thickness of 10 μm, followed by baking treatment. The coating surface was notched crosswise with a paper knife. The sample sheet was bulged by 5 mm with an Erichsen cupping tester, followed by observation on the exfoliation of the coating. The results are shown in Table 4.

TABLE 4

| temper rolling oil | coating | | |
|---|---|---|---|
| | acrylic coating | alkyd coating | melamine coating |
| Ex. 10 | free from exfoliation | free from exfoliation | free from exfoliation |
| Comp. Ex. 14 | occurrence of large exfoliation | occurrence of slight exfoliation | occurrence of slight exfoliation |

In the example, each coating was free from exfoliation. On the other hand, in the comparative example, exfoliation was observed in all the coatings although the degree of exfoliation was different from coating to coating. It is believed that the residual iron debris content and residual oil content in the example are smaller than those in the comparative example, which contributes to excellent adhesive properties.

EFFECT OF THE INVENTION

The inventions as desired in this specification, exhibit the following effects.

(1) Temper rolling at a reduction ranging from 0.5% to 30% can be smoothly conducted by making use of the water-soluble temper rolling oil of the present invention. Particularly, in the temper rolling with bright rolls, a steel sheet having less surface defects can be obtained.

(2) The use of the water-soluble cationic compound of the present invention in a concentration as low as 0.03 to 0.5% by weight in combination with a water-soluble rust preventive not only improves the lubricity but also normalizes the relationship between the rolling load and the elongation percentage.

(3) The water-soluble temper rolling oil of the present invention is so excellent in detergency with respect to the removal of metallic debris formed, that the occurrence of surface defects and lowering in the gloss of a rolled sheet can be greatly reduced.

(4) By virtue of the properties as mentioned in the above items (1) and (3), the water-soluble temper rolling oil of the present invention can be used in the rolling of materials which often present difficulties such as stainless steel sheet or titanium alloy, of which the surface gloss is an important factor.

(5) A material, such as a black plate for a tinplate, for which it is difficult to obtain a satisfactory elongation percentage because of its small sheet thickness and which was hitherto treated with a rolling mill of a multiple rolling stand type can be treated with a single stand rolling mill.

(6) A steel sheet which is temper rolled by the method of the present invention exhibits apparent dryness of its surfaces and is small in its degree of adherence of oil and iron, which makes it possible to omit the step of cleaning and to conduct a direct coating.

What is claimed is:

1. A temper rolling oil which comprises:

(A) a water-soluble cationic compound prepared by neutralizing a condensation product obtained by reacting the following compounds i to iii with each other by heating:

i. an aliphatic dicarboxylic acid having 6 to 22 carbon atoms, ii. at least one amino compound selected from the group consisting of (a)–(c):

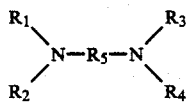

(a)

wherein $R_1$ to $R_4$ are each a hydrogen atom or an alkyl group having 1 to 3 carbon atoms, provided that at least one of them is a hydrogen atom, and $R_5$ is an alkylene group having 1 to 4 carbon atoms,

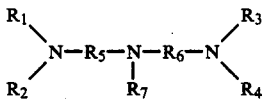

(b)

wherein $R_1$ to $R_4$ and $R_7$ are each a hydrogen atom or an alkyl group having 1 to 3 carbon atoms, provided that at least one of them is a hydrogen atom, and $R_5$ and $R_6$ are each an alkylene group having 1 to 4 carbon atoms, and $$H_2N(C_2H_4NH)_nH \quad (c)$$

wherein n is an integer of 3 to 5; and iii. a polyethyleneimine having an average molecular weight of 300 to 2,000, with at least one oxoacid of phosphorus selected from the group consisting of (d)–(f):

(d) phosphoric acid, phosphorous acid, hypophosphorous acid, and perphosphoric acid;

(e) a condensed product of an oxoacid of phosphorus selected from the group consisting of pyrophosphoric acid, trimetaphosphoric acid, tetrametaphosphoric acid, pyrophosphorous acid, polymetaphosphorous acid, and diperphosphoric acid; and (f) a compound selected from the group consisting of (I)-(III):

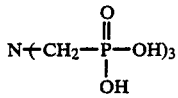

(I)

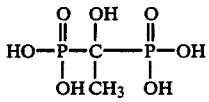

(II)

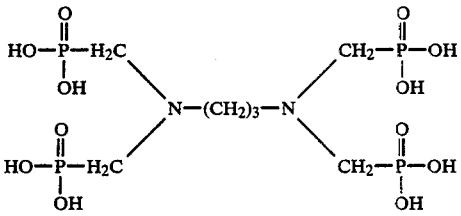

(III)

(B) an aqueous rust preventing component, and (C) water.

2. A method of temper rolling, comprising the steps of pickling a hot rolled steel sheet, subjecting the pickled steel sheet to cold rolling, annealing the resulting steel sheet, and rolling the annealed steel sheet with rollers, wherein said rolling of the annealed steel sheet is conducted at a reduction ranging from 0.5 to 30% using a diluted solution obtained by diluting a temper rolling oil which comprises:

(A) a water-soluble cationic compound prepared by neutralizing a condensed product obtained by reacting the following compounds i to iii with each other by heating:

i. an aliphatic dicarboxylic acid having 6 to 22 carbon atoms, ii. at least one amino compound selected from the group consisting of (a)-(c):

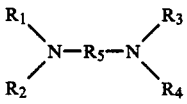

(a)

wherein $R_1$ to $R_4$ are all hydrogen atoms or alkyl groups having 1 to 3 carbon atoms, provided that at least one of them is a hydrogen atom, and $R_5$ is an alkylene group having 1 to 4 carbon atoms,

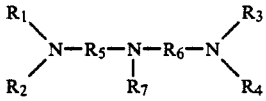

(b)

wherein $R_1$ to $R_4$ and $R_7$ are all hydrogen atoms or alkyl groups having 1 to 3 carbon atoms, provided that at least one of them is a hydrogen atom, and $R_5$ and $R_6$ are each an alkylene group having 1 to 4 carbon atoms, and

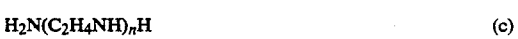

(c)

wherein n is an integer of 3 to 5, and iii. a polyethyleneimine having an average molecular weight of 300 to 2,000, with at least one oxoacid of phosphorus selected from the group consisting of (d)-(f):

(d) phosphoric acid, phosphorous acid, hypophosphorous acid, and perphosphoric acid;

(e) a condensed product of an oxoacid of phosphorus selected from the group consisting of pyrophosphoric acid, trimetaphosphoric acid, tetrametaphosphoric acid, pyrophosphorous acid, polymetaphosphorous acid, and diperphosphoric acid; and (f) a compound selected from the group consisting of (I)-(III):

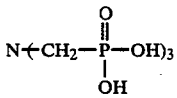

(I)

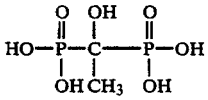

(II)

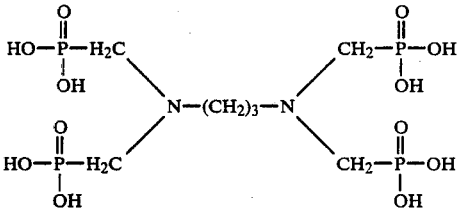

(III)

(B) an aqueous rust preventing component, and (C) water, so that the concentration of the water-soluble cationic compound contained therein is 300 to 5,000 ppm.

3. A temper rolling oil according to claim 1, wherein said aliphatic dicarboxylic acid having 6 to 22 carbon atoms is 1,10-dicarboxydecane.

4. A method of temper rolling according to claim 2, wherein said water-soluble rust preventing component contains 0.5 to 10% by weight of a water-soluble rust preventive concentrate.

* * * * *